US011491810B2

(12) United States Patent
Murata et al.

(10) Patent No.: US 11,491,810 B2
(45) Date of Patent: Nov. 8, 2022

(54) RECORDING DEVICE

(71) Applicant: SEIKO EPSON CORPORATION, Tokyo (JP)

(72) Inventors: Mitsuru Murata, Matsumoto (JP); Yosuke Nakano, Matsumoto (JP); Atsuhiko Takeuchi, Matsumoto (JP); Katsuhiko Otani, Suwa-gun Shimosuwa-machi (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 17/153,541

(22) Filed: Jan. 20, 2021

(65) Prior Publication Data

US 2021/0229474 A1 Jul. 29, 2021

(30) Foreign Application Priority Data

Jan. 23, 2020 (JP) ..... JP2020-008950

(51) Int. Cl.
*B41J 25/00* (2006.01)
*B41J 2/165* (2006.01)

(52) U.S. Cl.
CPC ..... *B41J 25/001* (2013.01); *B41J 2/16517* (2013.01)

(58) Field of Classification Search
None
See application file for complete search history.

(56) References Cited

U.S. PATENT DOCUMENTS 7,497,568 B2 * 3/2009 Kudoh ..... B41J 2/1652 347/104
8,944,554 B2 * 2/2015 Kondo ..... B41J 2/16523 347/14

FOREIGN PATENT DOCUMENTS

JP H06-115217 4/1994
JP 2014-014963 1/2014
JP 2015-185189 10/2015

* cited by examiner

*Primary Examiner* — Alejandro Valencia
(74) *Attorney, Agent, or Firm* — Workman Nydegger

(57) ABSTRACT

A recording device includes a recording head configured to discharge a liquid as a droplet, a carriage on which the recording head is mounted, a driving unit that causes the carriage to reciprocate along a guide shaft, and a control board on which a semiconductor element is mounted. In a state in which the carriage is positioned at one end of the guide shaft, the control board is disposed below the carriage.

5 Claims, 4 Drawing Sheets

RECORDING DEVICE

The present application is based on, and claims priority from JP Application Serial Number 2020-008950, filed Jan. 23, 2020, the disclosure of which is hereby incorporated by reference herein in its entirety.

BACKGROUND

1. Technical Field

The present disclosure relates to a recording device.

2. Related Art

In related art, as illustrated in JP-A-2015-185189, a recording device is known that includes a liquid discharge head that discharges a liquid, and a carriage on which the liquid discharge head is mounted and which can reciprocate in a main scanning direction. Further, a control board on which semiconductor elements and the like are mounted is disposed in the recording device.

However, with the recording device described above, if the position at which the control board is disposed is not considered, a problem arises in that a space covering the control board is unnecessarily increased, and a housing and consequently the recording device becomes larger.

SUMMARY

A recording device includes a recording head configured to discharge a liquid as a droplet a carriage on which the recording head is mounted, a driving unit configured to reciprocate the carriage along a guide shaft, and a control board on which a semiconductor element is mounted. In a state in which the carriage is positioned at one end of the guide shaft, the control board is disposed below the carriage.

DESCRIPTION OF EXEMPLARY EMBODIMENTS

1. First Embodiment

First, a configuration of a recording device 10 according to a first embodiment will be described.

The recording device 10 records an image and the like on a medium 22 by rotatably holding a roll body 25, which is formed by winding the medium 22 around a core member 23, and discharging a liquid onto a front surface of the medium 22 pulled out from the roll body 25. The recording device 10 is, for example, an ink jet-type large format printer that performs printing on a medium such as a sheet by discharging an ink, which is an example of the liquid. The large format printer is a printer capable of performing printing on the medium 22 having a short-side width of A3 (297 mm) or greater.

Figure 1:
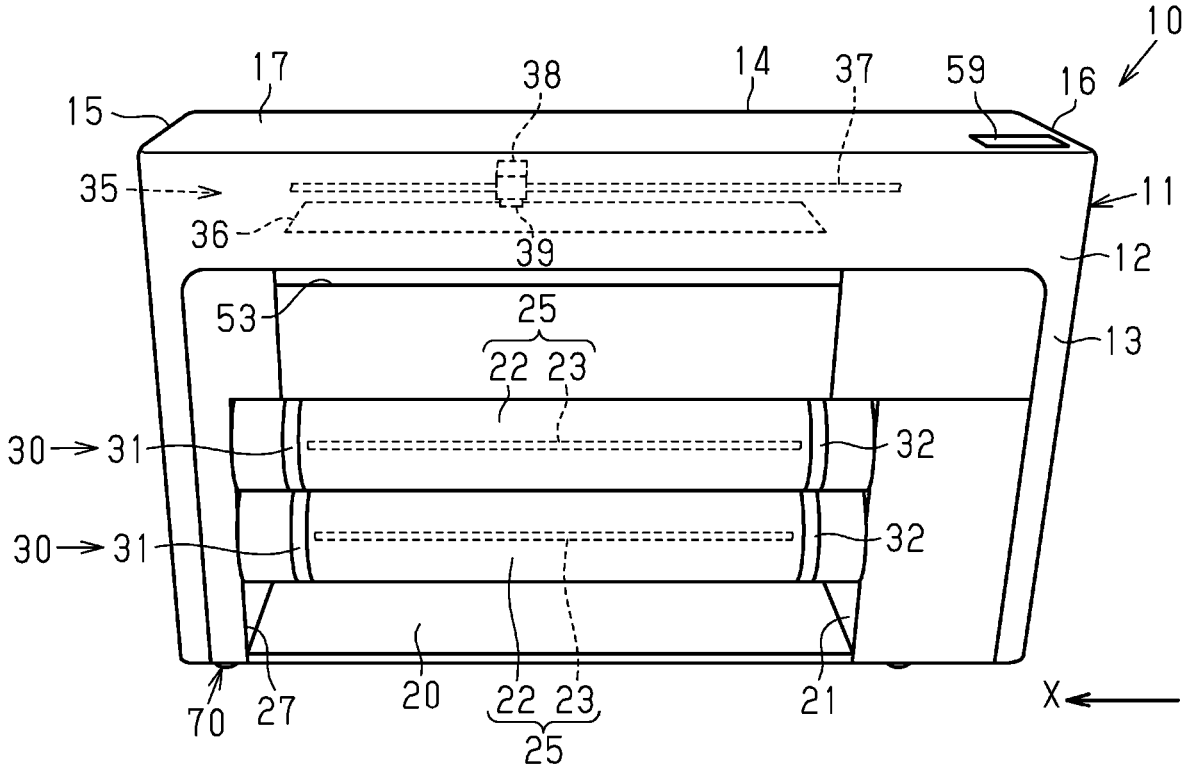
FIG. 1 is a front perspective view illustrating a configuration of a recording device according to a first embodiment.

As illustrated in FIG. 1, the recording device 10 includes a main body 11 and a leg unit 70. The main body 11 includes a substantially cuboid housing 12. The housing 12 includes a front wall 13, a back wall 14, a first side wall 15, a second side wall 16, and an upper wall 17. The housing 12 is coupled to a base frame 20 that is supported by the leg unit 70. In the recording device 10, a direction in which the base frame 20 and the upper wall 17 face each other is referred to as a height direction of the recording device 10. Further, a direction along a plane orthogonal to the height direction, in which the first side wall 15 and the second side wall 16 face each other, is referred to as a width direction of the recording device 10. A direction orthogonal to the width direction in the plane orthogonal to the height direction, in which the front wall 13 and the back wall 14 face each other, is referred to as a front-back direction of the recording device 10. When the recording device 10 is disposed such that the width direction and the front-back direction are on a horizontal plane, the height direction is a direction parallel to the gravitational direction. Note that in FIG. 1 to FIG. 3, the width direction of the recording device 10 is indicated by an X axis, the front-back direction is indicated by a Y-axis, and the height direction is indicated by a Z-axis. In addition, in FIG. 1 to FIG. 3, a direction in which an arrow faces is a positive direction, and, for example, one of directions in the width direction X is referred to as a positive X direction or the like.

Figure 2:
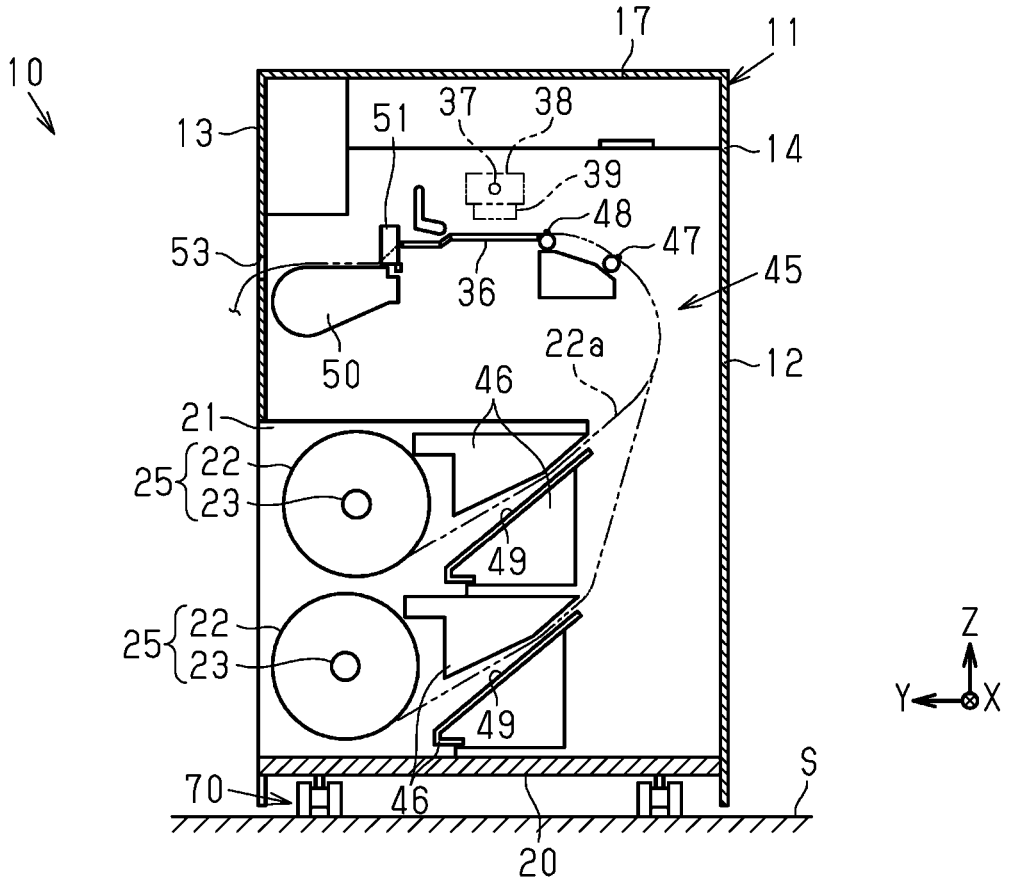
FIG. 2 is a cross-sectional view schematically illustrating an internal structure inside a housing according to the first embodiment.

As illustrated in FIG. 1 and FIG. 2, the main body 11 includes a housing unit 21. The housing unit 21 houses the cylindrical roll body 25 that is formed by winding the medium 22, onto which the main body 11 performs recording, around the core member 23. The housing unit 21 has an opening 27 provided on the base frame 20 side of the front wall 13 of the housing 12, and extends from the front wall 13 toward the back wall 14. In the present embodiment, the housing unit 21 is configured to be able to house a pair of the roll bodies 25 in a state in which the pair of roll bodies 25 are arranged side by side in the height direction of the recording device 10.

Figure 3:
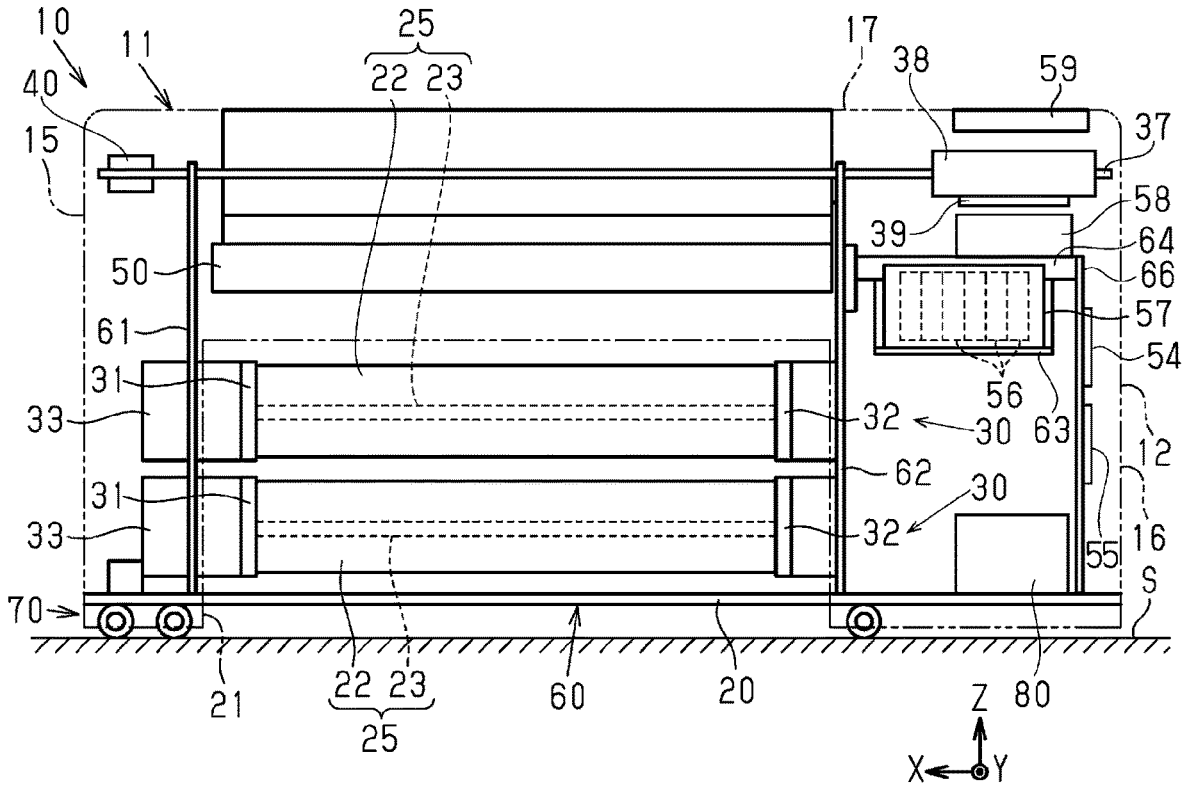
FIG. 3 is a front view schematically illustrating the internal structure inside the housing according to the first embodiment.

As illustrated in FIG. 1 to FIG. 3, a pair of holding units 30, which are rotatably mounted on the main body 11, are attached to each of the pair of roll bodies 25 housed in the housing unit 21. The holding unit 30 includes a first holding portion 31 that holds a first end of the roll body 25, and a second holding portion 32 that holds a second end of the roll body 25. The first and second holding portions 31 and 32 are removable from the main body 11 through the opening 27. In a state in which the first holding portion 31 and the second holding portion 32 are mounted on the main body 11, the first holding portion 31 and the second holding portion 32 are arranged side by side in the width direction of the recording device 10 inside the housing unit 21. Specifically, when the first holding portions 31 are attached to the first ends of the roll bodies 25, the second holding portions 32 are attached to the second ends of the roll bodies 25, and the roll bodies 25 are placed in the housing unit 21, the posture of the pair of roll bodies 25 is stabilized in a state in which the first holding portions 31 and the second holding portions 32 are arranged side by side in the width direction. The first holding portion 31 is mounted so as to be rotatable with respect to a first side frame 61 illustrated in FIG. 3, about an axis that serves as a rotation axis and extends along the width direction. The second holding portion 32 is mounted so as to be rotatable with respect to a second side frame 62 illustrated in FIG. 3, about an axis that serves as a rotation axis and extends in the width direction. By holding the roll body 25 using the first holding portion 31 and the second holding portion 32, the holding unit 30 holds the roll body 25 so that the roll body 25 can rotate about the center axis of the core member 23. The roll body 25 held by the first holding portion 31 and the second holding portion 32 is driven to rotate by a driving unit 33 illustrated in FIG. 3. The driving unit 33 is positioned further to the first side wall 15 side than the first holding portion 31, and by driving a drive motor (not illustrated) in a forward rotation, the first holding portion 31 and the second holding portion 32 are rotated in a direction in which the medium 22 wound around the roll body 25 is fed out toward the back wall 14 side inside the housing 12. The first holding portion 31 need not necessarily be removable with respect to the first side frame 61. Further, the second holding portion 32 need not necessarily be removable with respect to the second side frame 62.

The main body 11 includes a recording unit 35 inside the housing 12. The recording unit 35 includes a support 36, a guide shaft 37, a carriage 38, and a recording head 39.

The support 36 is positioned further to the upper wall 17 side than the housing unit 21. The support 36 is a plate-like member extending in the width direction inside the housing 12. After being unwound from the roll body 25 and transported to the support 36 inside the housing 12, the medium 22 is transported on the support 36 from the back wall 14 side toward the front wall 13 side.

The guide shaft 37 is positioned further to the upper wall 17 side than the support 36. The guide shaft 37 is a rod-like or plate-like member extending in the width direction. The guide shaft 37 supports the carriage 38 so that the carriage 38 is movable along the guide shaft 37. The carriage 38 is configured to be able to reciprocate along the guide shaft 37 by being driven by a carriage motor 40 illustrated in FIG. 3, which functions as a driving unit.

The recording head 39 is mounted on the carriage 38. The recording head 39 is positioned on the support 36 side with respect to the carriage 38. The recording head 39 performs recording on the medium 22 by discharging the liquid as a droplet onto the medium 22 supported by the support 36.

As illustrated in FIG. 2, the main body 11 includes a transport unit 45 inside the housing 12. The transport unit 45 transports the medium 22 unwound from the roll body 25 in cooperation with the holding unit 30. The transport unit 45 includes transport path forming portions 46, an intermediate roller 47, and a transport roller 48.

The transport path forming portions 46 are provided so as to correspond to each of the pair of roll bodies 25. The transport path forming portions 46 are positioned on the back wall 14 side with respect to each of the pair of roll bodies 25 housed in the housing unit 21. Each of the transport path forming units 46 forms a transport path 49 that guides a medium 22*a*, which is fed out from the roll body 25 as a result of the holding unit 30 being rotationally driven, toward the back wall 14 side of the housing 12.

The intermediate roller 47 and the transfer roller 48 transport the medium 22*a* that has passed through the transport path 49. Each of the intermediate roller 47 and the transport roller 48 is configured by a driving roller and a driven roller, which are a pair of rollers each supported so as to be rotatable about an axis that serves as a rotation axis and extends along the width direction. Using the driving roller and the driven roller, each of the intermediate roller 47 and the transfer roller 48 sandwiches and supports the medium 22*a* from both the front and back sides thereof.

By driving the drive motor (not illustrated) in the forward rotation in order to rotationally drive the intermediate roller 47 and the transport roller 48, the transport unit 45 transports the medium 22*a* to the support 36 via the transport path 49, and transports the medium 22*a*, on the support 36, from the back wall 14 side toward the front wall 13 side. Note that in FIG. 2, a state is illustrated in which the medium 22*a* is fed out from both of the pair of roll bodies 25. However, during actual recording, the medium 22*a* is fed out from only one of the pair of roll bodies 25.

As illustrated in FIG. 2, the main body 11 includes a paper discharge member 50 and a cutting unit 51 inside the housing 12. The paper discharge member 50 is positioned on the front wall 13 side with respect to the support 36, supports the medium 22*a* that has passed through the support 36, and guides the medium 22*a* to a paper exit 53 formed in the front wall 13. The cutting unit 51 cuts the medium 22*a*. The medium 22*a* cut by the cutting unit 51 is discharged from the paper exit 53.

As illustrated in FIG. 3, the main body 11 includes a mounting unit 57 on which a cartridge 56 is mounted that contains the liquid to be supplied to the recording head 39. The mounting unit 57 is positioned further to the second side wall 16 side than the first holding portions 31 and the second holding portions 32, and is positioned further to the upper wall 17 side than the first holding portions 31 and the second holding portions 32. The cartridge 56 is coupled to the recording head 39 via a flexible tube (not illustrated). When the pressure of the liquid inside the recording head 39 drops due to the discharge of the liquid by the recording head 39, the cartridge 56 supplies the liquid to the recording head 39 through the tube.

As illustrated in FIG. 3, the main body 11 includes a maintenance unit 58 that performs maintenance of the recording head 39. The maintenance unit 58 is positioned further to the second side wall 16 side than the holding units 30. The maintenance unit 58 is positioned further to the upper wall 17 side than the first holding portions 31 and the second holding portions 32, and is positioned further to the base frame 20 side than the recording head 39. The maintenance unit 58 performs a cleaning operation that causes the liquid to be discharged from the recording head 39 by reducing the pressure inside the recording head 39, for example, using a cap and a discharge pump (not illustrated).

A waste liquid storage tank 80 is disposed below the maintenance unit 58. The waste liquid storage tank 80 is a container that contains the liquid discharged from the recording head 39 in the maintenance unit 58. The maintenance unit 58 and the waste liquid storage tank 80 are coupled to each other via a flexible tube (not illustrated). The liquid discharged from the recording head 39 is stored, via the tube, in the waste liquid storage tank 80 as waste liquid.

As illustrated in FIG. 1 and FIG. 3, the main body 11 includes an operation unit 59. The operating unit 59 is provided on the upper wall 17 of the housing 12. The operating unit 59 is positioned at a corner portion that is formed by a section at which the front wall 13 is coupled to the upper wall 17 and at which the second side wall 16 is coupled to the upper wall 17. The operation unit 59 is configured, for example, by a touch panel or the like, and used by a user when they input various types of information.

As illustrated in FIG. 3, the main body 11 includes a frame body 60. In addition to the housing 12, the frame body 60 supports various types of members and units mounted on the main body 11, such as the holding units 30, the recording unit 35, the transport unit 45, the mounting unit 57, and the maintenance unit 58, which are described above. The frame body 60 includes the base frame 20, the first side frame 61, the second side frame 62, a third side frame 66, a first coupling frame 63, and a second coupling frame 64. A direction in which the first side frame 61, the second side frame 62, and the third side frame 66 are arranged side by side is the width direction of the recording device 10.

The base frame 20 extends in the width direction inside the housing 12 so as to form a bottom wall of the housing 12. The base frame 20 is supported by the leg unit 70 from a side of an installation surface S.

The first side frame 61 is positioned further to the first side wall 15 side than the housing unit 21. The first side frame 61 is coupled to the base frame 20 and extends from the base frame 20 in the height direction. The first side frame 61 supports the first holding portions 31 of the holding units 30. The first holding portion 31 is supported so as to be rotatable about the axis that is the rotation axis and extends along the width direction. Further, the first side frame 61 supports the driving units 33 that drive the holding units 30. The driving units 33 are positioned on the opposite side from the second side frame 62 with respect to the first side frame 61.

The second side frame 62 is positioned further to the second side wall 16 side than the housing unit 21. The second side frame 62 is coupled to the base frame 20 and extends from the base frame 20 in the height direction. The second side frame 62 supports the second holding portions 32 of the holding units 30. The second holding portion 32 is supported so as to be rotatable about the axis that serves as the rotation axis and extends along the width direction.

The third side frame 66 is disposed below the guide shaft 37 and along the Z axis that is a direction intersecting the extending direction of the guide shaft 37. More specifically, the third side frame 66 is positioned further to the second side wall 16 side than the second side frame 62. The third side frame 66 is coupled to the base frame 20 and extends from the base frame 20 in the height direction.

The first coupling frame 63 is coupled to the second coupling frame 64 so as to be suspended from the second coupling frame 64. The first coupling frame 63 is positioned between the second side frame 62 and the second side wall 16. The above-described mounting unit 57 is supported by the first coupling frame 63. In other words, the mounting unit 57 is located at a position separated from the second side frame 62 on the opposite side from the first side frame 61 with respect to the second side frame 62, is supported by the first coupling frame 63, and is supported by the second side frame 62 via the second coupling frame 64.

The second coupling frame 64 is a member coupled to the second side frame 62 and positioned between the second side frame 62 and the second side wall 16. The second coupling frame 64 is positioned further to the upper wall 17 side than the first coupling frame 63. The above-described maintenance unit 58 is supported by the second coupling frame 64. In other words, the maintenance unit 58 is positioned on the opposite side from the first side frame 61 with respect to the second side frame 62, and is supported by the second side frame 62 via the second coupling frame 64.

The leg unit 70 supporting the base frame 20 from the installation surface S side includes a plurality of casters as support legs each having a contact portion that can come into contact with the installation surface S. The caster includes a wheel that rotates along with the movement of the recording device 10, and the orientation of the wheel can be changed by the caster rotating about an axis that serves as a rotation axis and extends along the height direction. Further, each of the casters includes a locking mechanism (not illustrated) that regulates the rotation of the wheel. The installation surface S is a surface on which the main body 11 (the recording device 10) is installed.

Further, the recording device 10 is provided with a control board 54 on which semiconductor elements and the like are mounted. The control board 54 controls various objects for control, such as the transport unit 45 and the recording unit 35.

Here, in a state in which the carriage 38 is positioned at one end of the guide shaft 37, the control board 54 is disposed below the carriage 38. In the present embodiment, as illustrated in FIG. 3, in a state in which the carriage 38 is positioned at an end of the guide shaft 37 in a negative X direction, the control board 54 is disposed below the carriage 38. Note that the state in which the carriage 38 is positioned at the end of the guide shaft 37 in the negative X direction is a state in which the carriage 38 faces the maintenance unit 58. In other words, in a state in which the carriage 38 is positioned at a limit position of a movable range of the guide shaft 37 in the negative X direction, the control board 54 is disposed below the carriage 38. Since the control board 54 is disposed within a movement range of the carriage 38, an increase in size of the recording device 10 in the direction along the guide shaft 37 can be suppressed.

Further, in the present embodiment, the control board 54 is attached to a surface of the third side frame 66, which serves as a side frame. Specifically, the control board 54 is attached to the surface, on the negative X direction side, of the plate-like third side frame 66. As a result, the control board 54 is disposed in a stable state.

Further, the control board 54 is disposed substantially in the center of the third side frame 66 in the direction along the Y axis. As a result, the increase in size of the recording device 10 in the front-back direction can be suppressed.

The control board 54 is disposed on the third side frame 66 above the waste liquid storage tank 80. As a result, when performing an operation for removing the waste liquid storage tank 80 from the housing 12 to the outside, the waste liquid storage tank 80 can be prevented from coming into contact with the control board 54.

Further, the recording device 10 is provided with a power supply board 55 on which power supply elements and the like are mounted. The power supply board 55 is attached to the surface, on the negative X direction side, of the third side frame 66. The power supply board 55 is disposed in close proximity to the control board 54 and wired to the control board 54. As a result, routing of the wiring between the power supply board 55 and the control board 54 can be easily performed. Then, the power is supplied from the power supply board 55 to the various objects for control via the control board 54.

2. Second Embodiment

Next, a second embodiment will be described. Note that the same constituent elements as those of the first embodiment will be denoted by the same reference signs, and redundant descriptions will be omitted.

Figure 4:
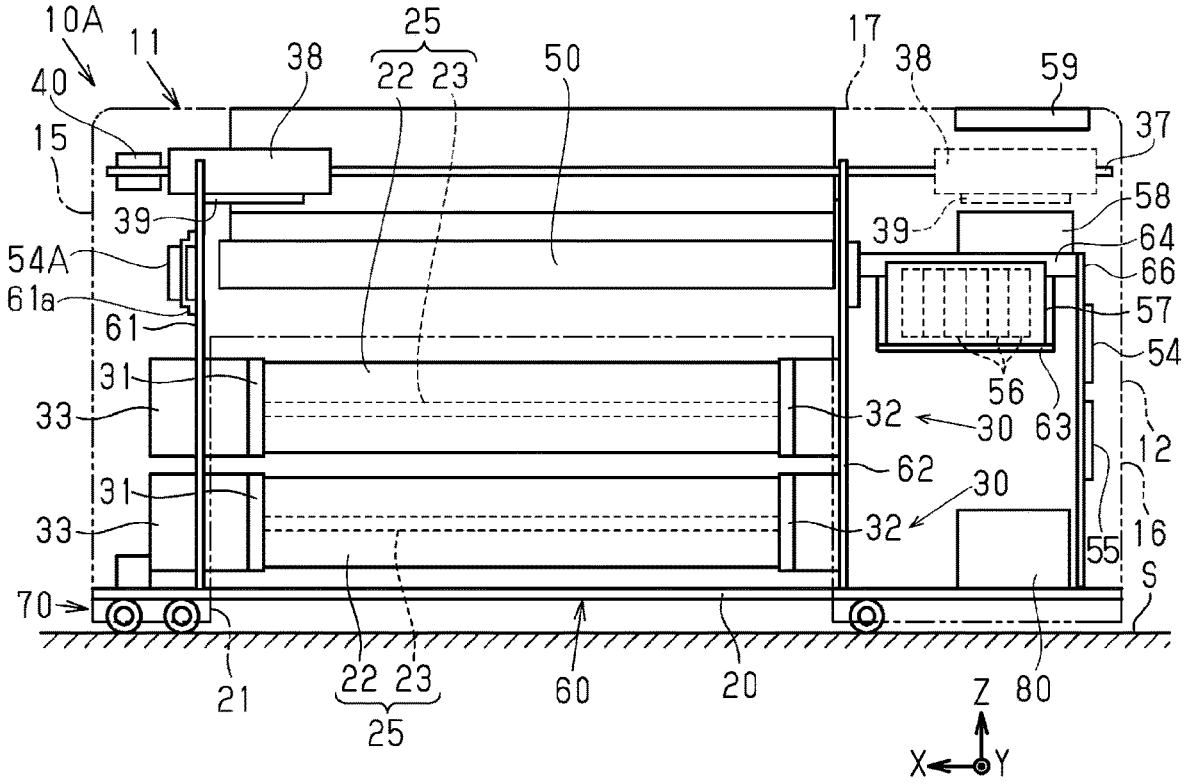
FIG. 4 is a front view schematically illustrating an internal structure inside the housing according to a second embodiment.

As illustrated in FIG. 4, a recording device 10A includes another control board 54A in addition to the control board 54. As the recording device 10A becomes more advanced, the number of parts of driving members increases, and when all of control elements and the like cannot be accommodated on the control board 54, the other control board 54A is required. The other control board 54A and the control board 54 are respectively responsible for different objects for control, and semiconductor elements and the like for controlling the driving members, excluding the objects for control controlled by the control board 54, are mounted on the other control board 54A.

The other control board 54A is disposed below the carriage 38 in a state in which the carriage 38 is positioned at the other end of the guide shaft 37. In the present embodiment, as illustrated in FIG. 4, the other control board 54A is disposed below the carriage 38 in a state in which the carriage 38 is positioned at an end of the guide shaft 37 in the positive X direction. In other words, in a state in which the carriage 38 is positioned at a limit position of the movable range of the guide shaft 37 in the positive X direction, the other control board 54A is disposed below the carriage 38. Since the control board 54 and the other control board 54A are disposed within the movement range of the carriage 38 in the direction along the X axis of the carriage 38, even with a configuration in which a plurality of boards, namely, the control board 54 and the other control board 54A, are provided, the increase in size of the recording device 10 in the direction along the guide shaft 37 can be suppressed.

In the present embodiment, the other control board 54A is attached to a surface, on the positive X direction side, of the first side frame 61 via a mounting frame 61*a*. As a result, the other control board 54A is disposed in a stable state.

The other control board 54A is disposed substantially in the center of the first side frame 61 in the direction along the Y axis. As a result, an increase in size of the recording device 10A in the front-back direction can be suppressed.

Further, the control board 54 and the other control board 54A are disposed so as to be separated from each other in the direction along the X axis of the recording device 10A. As a result, among the plurality of driving members and the like disposed inside the housing 12, the driving members disposed at positions closer to the control board 54 than to the other control board 54A are wired to the control board 54, and the driving members disposed at positions closer to the other control board 54A than to the control board 54 are wired to the other control board 54A, for example. As a result, the length of the wiring that couples each of the driving members with the control board 54 and the other control board 54A, respectively, can be shortened, and an operation for routing the wiring can thus be easily performed. Note that examples of the driving member include various motors, sensors, and the like.

Further, the power supply board 55 is attached to the same third side frame 66 as the control board 54. Then, in the present embodiment, of the control board 54 and the other control board 54A, the power supply board 55 is wired to the control board 54, which is disposed closer to the power supply board 55. Further, the control board 54 and the other control board 54A are wired to the power supply board 55. As a result, the control board 54, which is coupled to the power supply board 55, can adjust the voltage and supply the voltage to the other control board 54A. In other words, the routing of the wiring becomes easier than a case in which the wiring is routed from the power supply board 55 to both the control board 54 and the other control board 54A. Note that the power supply board 55 may be attached to the first side frame 61 instead of the third side frame 66, and may be wired to the other control board 54A.

What is claimed is:

1. A recording device comprising:

a recording head configured to discharge a liquid as a droplet;

a carriage on which the recording head is mounted;

a driving unit configured to reciprocate the carriage along a guide shaft;

a liquid mounting section configured to mount a liquid container that holds the liquid; and a control board on which a semiconductor element is mounted, wherein in a state in which the carriage is positioned at one end of the guide shaft, the control board is disposed below the carriage, wherein the liquid mounting section is disposed on a same side of the recording device as the control board, wherein in the state in which the carriage is positioned at the one end of the guide shaft, the liquid mounting section is disposed below the carriage, wherein a plate-like side frame is disposed below the guide shaft and along a direction intersecting an extending direction of the guide shaft, and the control board is attached to a surface of the side frame, wherein the control board and the liquid mounting section are arranged so as to sandwich the side frame, and wherein in the state in which the carriage is positioned at the one end of the guide shaft, the control board and the liquid mounting section are disposed below the carriage.

2. The recording device according to claim 1, comprising:

a second control board in addition to the control board, wherein the second control board is disposed below the carriage in a state in which the carriage is positioned at another end of the guide shaft.

3. The recording device according to claim 2, comprising:

a power supply board on which a power supply element is mounted, wherein the control board and the second control board are wired to each other, and the power supply board is wired to one of the control board or the second control board.

4. A recording device comprising:

a recording head configured to discharge a liquid as a droplet;

a carriage on which the recording head is mounted;

a driving unit configured to reciprocate the carriage along a guide shaft;

a control board on which a semiconductor element is mounted;

a liquid mounting section configured to mount a liquid container that holds the liquid; and a plate-like side frame disposed along a direction intersecting an extending direction of the guide shaft, wherein the control board is attached to a surface of the side frame within a movement range of the carriage, wherein the liquid mounting section is disposed on a same side of the recording device as the side frame, wherein in a state in which the carriage is positioned at one end of the guide shaft, the liquid mounting section is disposed below the carriage wherein the control board and the liquid mounting section are arranged so as to sandwich the side frame, and wherein in the state in which the carriage is positioned at the one end of the guide shaft, the control board and the liquid mounting section are disposed below the carriage.

5. The recording device according to claim 4, comprising:

a maintenance unit configured to perform maintenance on the recording head, wherein the side frame is disposed closer to an outer side of the recording device than the maintenance unit is.

* * * * *